US007900682B2

(12) United States Patent
Calvino, Jr.

(10) Patent No.: US 7,900,682 B2
(45) Date of Patent: Mar. 8, 2011

(54) GARAGE SECTIONAL DOOR INSULATION SYSTEM

(76) Inventor: John Calvino, Jr., Coral Springs, FL (US)

( * ) Notice: Subject to any disclaimer, the term of this patent is extended or adjusted under 35 U.S.C. 154(b) by 358 days.

(21) Appl. No.: 12/102,155

(22) Filed: Apr. 14, 2008

(65) Prior Publication Data

US 2009/0255636 A1 Oct. 15, 2009

(51) Int. Cl.
*E06B 3/00* (2006.01)

(52) U.S. Cl. ..... 160/232; 160/236; 52/784.15; 52/407.3

(58) Field of Classification Search ..... 160/236, 160/232; 52/309.9, 784.15, 407.3, 406.1
See application file for complete search history.

(56) References Cited

U.S. PATENT DOCUMENTS

| | | | | |
|---|---|---|---|---|
| 4,119,133 | A | 10/1978 | Wolf | |
| 4,284,119 | A * | 8/1981 | Martin et al. | 160/232 |
| 4,779,325 | A * | 10/1988 | Mullet | 29/460 |
| 5,016,700 | A * | 5/1991 | Wegner et al. | 160/232 |
| 5,177,868 | A * | 1/1993 | Kyle et al. | 29/897.32 |
| 5,435,108 | A | 7/1995 | Overholt et al. | |
| 5,509,457 | A * | 4/1996 | Jella | 160/201 |
| 5,787,677 | A * | 8/1998 | Bolich et al. | 52/784.15 |
| 6,152,259 | A | 11/2000 | Freist et al. | |
| 6,725,898 | B2 * | 4/2004 | Mullet et al. | 160/232 |
| 6,772,818 | B2 | 8/2004 | Whitley et al. | |
| 7,383,872 | B1 * | 6/2008 | Jella | 160/236 |
| 7,431,068 | B1 * | 10/2008 | Jella | 160/236 |
| 2006/0010807 | A1 | 1/2006 | Whitley | |
| 2009/0255636 | A1 * | 10/2009 | Calvino, Jr. | 160/201 |

FOREIGN PATENT DOCUMENTS

| | | |
|---|---|---|
| DE | 19754046 | 12/1997 |
| FR | 2772825 | 12/1997 |

* cited by examiner

*Primary Examiner* — Blair M. Johnson
(74) *Attorney, Agent, or Firm* — Christopher & Weisberg, P.A.

(57) ABSTRACT

A sectional door insulation system has one or more insulation blocks attached to a protective sheet. Small grooves between the insulation blocks and the protective sheet accommodate brackets on the lower and upper walls of the section of a door, such as a garage door. The secure engagement of the brackets of the door and grooves of the panel holds the panel firmly attached to the door section. The protective panel may have a textured surface. The insulating block may optionally include a barrier foil and tabs.

17 Claims, 7 Drawing Sheets

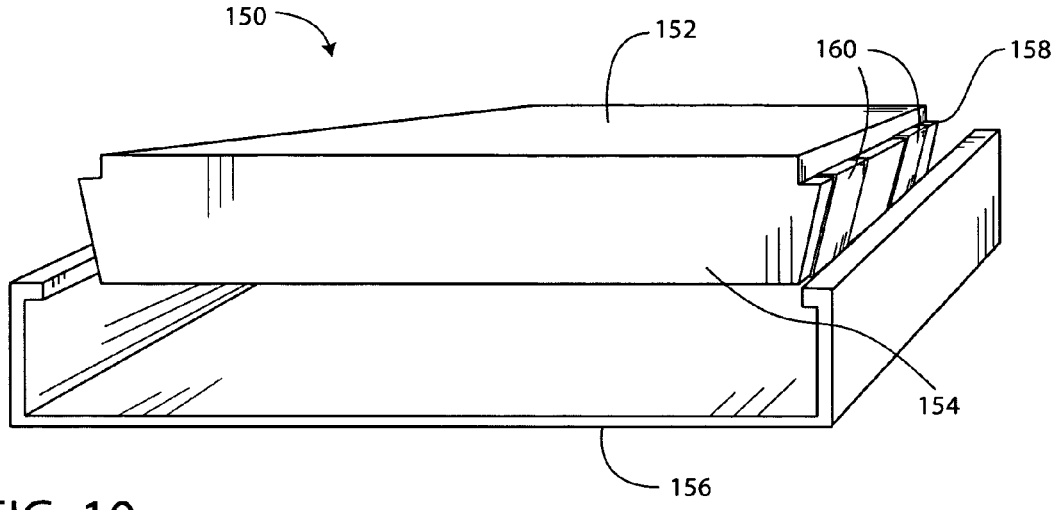
FIG. 10
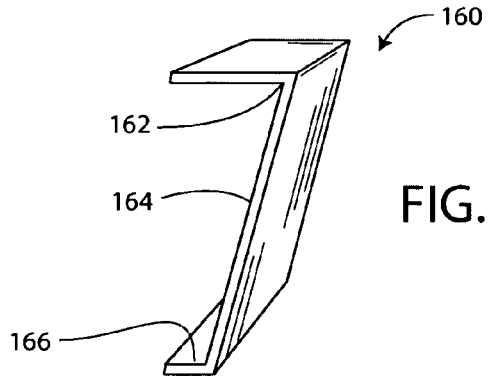
FIG. 11
FIG. 12
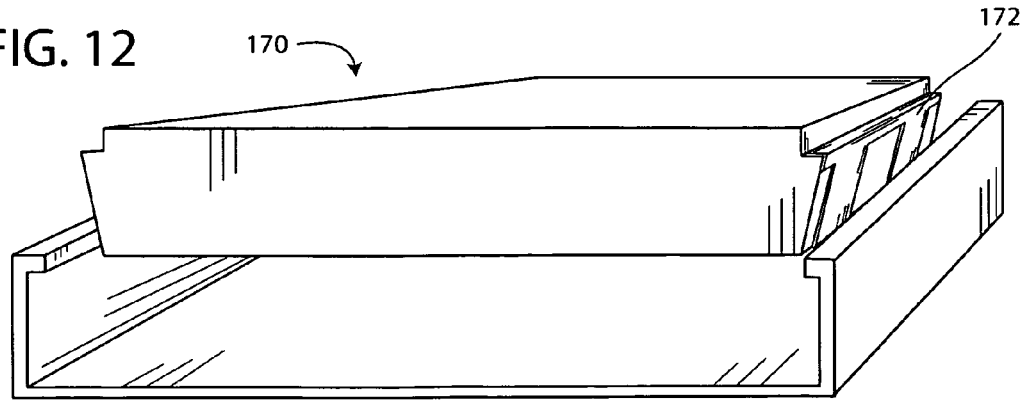

GARAGE SECTIONAL DOOR INSULATION SYSTEM

CROSS-REFERENCE TO RELATED APPLICATIONS

None

STATEMENT REGARDING FEDERALLY SPONSORED RESEARCH OR DEVELOPMENT

None

REFERENCE TO SEQUENCE LISTING, A TABLE, OR A COMPUTER PROGRAM LISTING COMPACT DISC APPENDIX

None

BACKGROUND

1. Field of the Invention

The present invention relates to an insulation system for garage sectional doors. More particularly, the invention relates to an insulation system that provides thermal and audio insulation to a door comprised of multiple sections, such as a garage door.

2. Prior Art

It is convenient for large doors, such as a garage door, to be designed as a series of horizontal sections. The sections are typically divided into panels by a series of stiles and connected to one another by hinges. A series of wheels engage a pair of rails extending along an opening and ceiling of a garage. The garage door is opened by raising the sectional door along the rails until it is engaged with the ceiling portion of the rails. It is preferable to facilitate the opening process by using lightweight material to construct the door.

Garage door sections are typically made of a single, thin wall of sheet metal. This allows the door sections to be light weight and extremely durable. However, sheet metal is very thermally conductive and provides very poor insulation. Garages are consequently a major source of leakage of a controlled climate. This significantly adds to the cost of heating or cooling a structure having a garage. It also makes them impractical for use as an indoor activity area in addition to a storage facility.

It is known to construct garage doors having insulation between two metal walls, as shown in U.S. Pat. No. 5,435,108 to Overholt et al. Such a design adds significant cost to the manufacturing of the door and is not suitable for retrofitting existing doors.

U.S. Pat. No. 5,787,677 shows a garage door insulation system that has an outer wall of sheet metal, an inner wall of concrete and an insulating layer. Concrete adds considerable weight. And the multi-layer process significantly complicates manufacture of the door. This design is also not conducive to retrofitting insulation to existing garage doors.

More recently, various retro-fit insulating kits have become available for garage doors. These kits allow an insulating material to be applied to existing sectional doors. Typically, they require an insulating material to be permanently attached to the inside of a sectional door panel by means of an adhesive.

Adhesives that effectively bond to a metal surface typically are corrosive to many materials, are toxic and many such glues emit unpleasant and/or toxic fumes. This is disadvantageous because the insulation is applied while the garage door is in the closed position. This necessarily requires that a person applying a glue be exposed to the toxic fumes in a closed room without ventilation. Furthermore, metal substantially expands and contracts as temperature changes. This causes the bonding between a metal sectional door and its insulation to deteriorate. An adhesive itself is often susceptible to degradation when exposed to extreme conditions. Insulation must therefore be periodically reattached or replaced.

Many garage door insulation kits also require the use of tools and application of substantial force to the components. The difficulty and complexity of installing these kits make them impractical and unappealing to persons with limited home improvement skills and ability.

Metal garage and other sectional doors typically have upper and lower walls and protruding lips that provide strength. They often include vertical stiles also having strengthening lips. Insulating sheets having the proper dimensions can be inserted into the void space of the panels of these door sections to provide insulation. However, the insulating sheets are not locked in securely and may loosen and move about. This increases wear on the insulating sheets. It also creates a potential hazard as a sheet may detach and fall, especially when the door is in the up position. It is also not aesthetically pleasing.

It is therefore desirable to provide a means for retrofitting insulation to existing sectional doors.

It is also desirable to provide a means for easily retrofitting insulation to existing sectional doors that does not require adhesives or tools and substantially fills void spaces in the doors.

It is also desirable to provide a means for easily retrofitting insulation to existing sectional doors that has an aesthetically pleasing appearance.

SUMMARY OF THE INVENTION

The present invention provides a system for insulating sectional doors including pre-existing garage doors. Installation requires no tools, tape or adhesives. It preferably has a textured outer surface that is aesthetically pleasing. The insulation panels of the invention are light weight and covered by a protective sheet to prevent damage.

The invention is comprised of an insulating block of material that is bonded directly to a polymer sheet. The insulating block is preferably exposed to the polymer sheet during the curing process such that the material of the block contacting the sheet is integrated into the matrix of the polymer as it cures in order to tightly bond the insulating block to the protective sheet without the need for glue or other adhesive. This method of bonding the block and the sheet together is generally preferred to most methods using an adhesive.

The insulating block has two grooves formed on its upper and lower surfaces between the insulating block and the protective sheet. The block has sloped top and bottom surfaces and an outer surface that is sized to fit into a void space on the interior wall of a sectional door. The block is formed of an insulating and mildly compressible material, such as expanded polystyrene (EPS). Because the block is compressible, the invention may be pressed in to the void space of a door. Brackets extending from the upper and lower walls of the door section are accommodated within the grooves and hold the insulating block firmly in place. If a door section is partitioned into individual panels by a series of vertical stiles, the insulation panel may be comprised of one protective sheet wide enough to cover an entire door section and having a plurality of insulation blocks designed to fit into the individual cells between the stiles.

There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Optionally, a thin foil barrier is included on the surface of the insulating block within the void, which may or may not be in contact with the outer wall of the door section. Insulating inserts may also be optionally inserted in the void space of the door section behind brackets and stiles to further insulate the door.

It is therefore an object of the invention to provide a sectional door insulation system that is lightweight and easy to install.

It is another object of the invention to provide a sectional door insulation system that is lightweight and easy to install and has a protective outer covering that may be formed or modified so that it is aesthetically pleasing.

BRIEF DESCRIPTION OF THE DRAWINGS

FIG. 10 is an alternative embodiment of the invention.

FIG. 11 is a perspective view of a tab of the alternative embodiment of the invention of FIG. 10.

FIG. 12 is an alternative embodiment of the invention.

DETAILED DESCRIPTION OF THE INVENTION

The invention provides an apparatus and method for easily providing substantial insulation for a sectional door, such as a garage door. The invention may be used for any suitable door or structure having one or more void spaces. The invention is especially suited for sectional doors having brackets or other protrusions around a void space that may engage a groove in the insulating panel. The insulating panels of the invention are light weight and are installed by simply pushing the insulating block into a void space. The invention is therefore well suited for garage doors that are already installed and in use. The invention may also be incorporated into a sectional door at the time of manufacture or prior to installation. The invention may be installed by professional installers or persons having little or no skill in the art of insulation installation. Anyone may use the invention to readily, safely and effectively insulate storage areas in an aesthetically pleasing manner.

Figure 1:
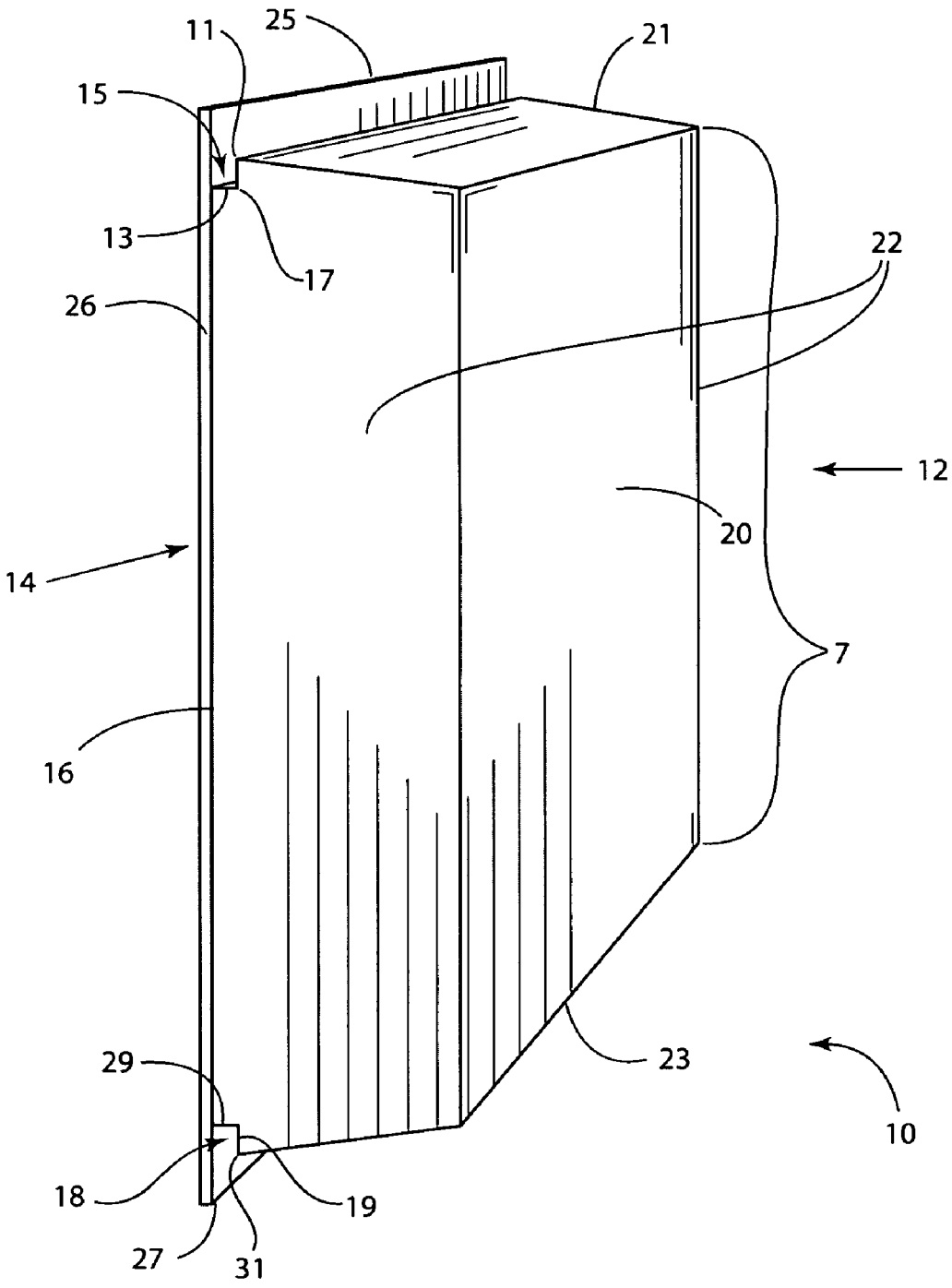
FIG. 1 is a perspective view of an insulation panel of the invention.

FIG. 1 shows a perspective view of a basic insulation panel 10 of the invention. The panel 10 is comprised primarily of insulating block 12 and protective sheet 14. Block 12 has an outer surface 20 with a height 7, a sloped top surface 21, a sloped bottom surface 23 and two sides 22. The insulating block 12 is bonded to protective sheet 14 at interface 16. Protective sheet 14 has a top 25, a bottom 27, and end 26.

Top groove 15 is located between top surface 21 and protective sheet 14. Top lip 11, top shelf 17 and top groove floor 13, form a top indentation in block 12. Protective sheet 14 joins block 12 at interface 16, thereby combining with the top indentation of block 12 formed by top lip 11, top shelf 17 and top groove floor 13 to form top groove 15. Similarly, groove 18 is located between bottom lip 23 and sheet 14, formed by sheet 14 and the indentation formed by bottom lip 31, bottom shelf 19 and bottom groove floor 29, which similarly ends at interface 16 with sheet 14. Groove floors 13 and 29 define the deepest recess points of grooves 15 and 18, respectively. Grooves 15 and 18 lie between block 12 and sheet 14 and facilitate secure attachment of the insulation panel 10 to a garage door section or other structure. Grooves 15 and 18 are designed to accommodate opposing top and bottom brackets or other structures that are spaced apart a distance less than the distance between upper lip 11 and lower lip 31 but greater than or equal to the distance between floors 13 and 29. Lips 11 and 31 are sufficiently compressible to allow brackets or other structures to be slid along top surface 21 and bottom surface 23, thereby compressing lips 11 and 31 until the brackets or other structures enter grooves 15 and 18. Lips 11 and 31 are sufficiently rigid such that they decompress once the brackets or other structures enter grooves 15 and 18 and such that they adequately retain the brackets or other structures firmly within grooves 15 and 18.

It is preferred to use a very lightweight insulation material to form the block 12 of the invention. Insulating block 12 is preferably formed from thermally insulating material that is lightweight and slightly compressible, at least along the top surface 21 and bottom surface 23. Expanded polymers, such as, but not limited to, expanded polystyrene (EPS), expanded polyurethane, expanded polyolefins, foam rubber, combinations thereof and like materials having these qualities are optimal for use with the invention. Those skilled in the art will appreciate that such expanded, porous polymers are inexpensive, readily available, easy to form and insulating. For these and other reasons, such materials are well suited for the invention. However, other materials that are both insulating and slightly compressible are similarly well suited for the invention.

As explained herein, block 12 is preferably compressible along its top surface 21 and bottom surface 23. Block 12 may therefore be comprised of more than one material. Optionally, block 12 may be comprised of one or more core blocks of a less compressible material and surrounded by a more compressible material, thereby providing compressibility along top surface 21 and bottom surface 23. Optionally, block 12 may include one or more cavities that may or may not be fillable with one or more materials. For example, block 12 may be comprised of a slightly compressible but still somewhat firm material such as an elastomeric material such as rubber or the like, and having a cavity at least partially filled with an insulating very lightweight and very compressible material, such as but not limited to foam rubber. Construction of block 12 may be further complicated by using noncompressible insulating materials having a top and bottom surfaces and lips that are compressed by means of a spring mechanism. Such spring loaded tabs are well known in the art and are commonly used as tabs for locking or snapping objects into place. However, it is generally preferred for simplicity of manufacture that block 12 be formed having nonmoving parts and more preferably being comprised of a single, solid material.

Top surface 21 is sloped downward from lip 11 to outer surface 20. Bottom surface 23 is sloped upward from lip 31 to outer surface 20. Sides 22 are therefore substantially trapezoidal in shape, and the entire block 12 has a substantially trapezoidal vertical cross section. Preferably, height 7 of outer surface 20 is less than the distance between top lip 11 and bottom lip 31. The size of the outer surface 20 and angled slopes of top surface 21 and bottom surface 23 allow block 12 to be easily inserted into the void space of a sectional door or similar structure.

Sheet 14 is preferably about ½-⅛ inch thick. Thickness may vary so long as sheet 14 remains thick enough to provide protection for panel 10 and thin enough that it does not add unnecessary weight to panel 10. It is attached to block 12 at interface 16, preferably by chemical means. Sheet 14 may be comprised of any durable material. Polymer materials are inexpensive moldable, pliable and readily available and therefore well suited for use as a material to comprise a durable sheet for the invention. Polyureas are well suited for the invention. Polyurea is defined as a reaction product of an isocyanate prepolymer and an amine-terminated prepolymer resulting in a polymer based on a urea linkage group. Polyurea is preferred in the invention because of its extreme durability, strong resistance to corrosion, pliability and relatively mild curing process. The polyurea curing process makes it especially well suited for chemical bonding at interface 16 as described herein. However, other polymers that are similarly durable such as but not limited to polyurea/polyurethane blends, polyolefins and the like may also be used. Such other materials are preferably bonded by similar means as that described in FIG. 3 and the accompanying text. However, adhesives, mechanical means such as screws, nut and bolts and the like, and other methods may be used to fixedly attach sheet 14 to block 12. Interface 16 is preferably planar, as shown herein. However, interface 16 may comprise any of a variety of geometries so long as the bonding between block 12 and sheet 14 is sufficiently durable.

Figure 2:
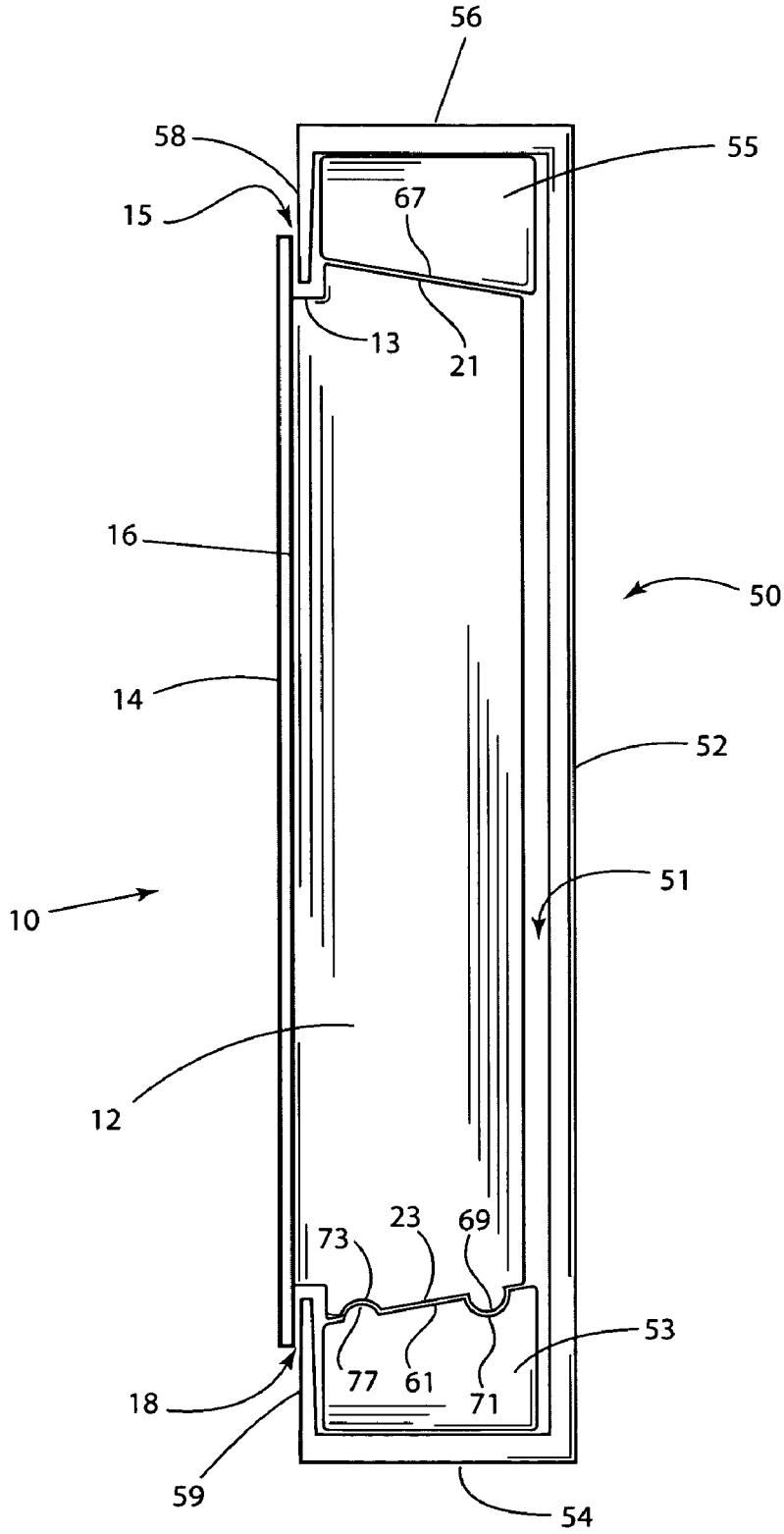
FIG. 2 is a side view of an insulation panel engaged with a door section.

FIG. 2 shows the panel 10 of FIG. 1 engaged to a garage door section 50. Door section 50 is a typical horizontal section of a sectioned garage door. It has an outside wall 52 that faces the outside and the elements. Top wall 56 is designed to abut and engage a horizontal door section (not shown) above section 50. Similarly, bottom wall 54 is designed to abut a door section below section 50 or the ground. Top wall 56 and bottom wall 54 are substantially perpendicular to outer wall 52 and extend inward. Upper bracket 58 protrudes downward from top wall 56 and lower bracket 59 protrudes upward from bottom wall 54. Brackets 59 and 58 are generally substantially perpendicular to walls 54 and 56 respectively and are typically included in the manufacture of a garage door section to increase the strength and rigidity of the structure.

An insulating panel 10 is attached to garage door section 50 by a tongue and groove type interaction between grooves 15 and 18 and brackets 58 and 59 respectively. Because brackets 58 and 59 are rigid and grooves 15 and 18 are substantially rigid and designed to accommodate brackets 58 and 59, panel 10 is held securely in place. Panel 10 is attached to a door section 50 in this way by simply pressing the panel 10 into the void space 51 of door section 50. The height 7 of outer surface 20 of block 12 is preferably at least slightly smaller than the distance between brackets 58 and 59. The top and bottom surfaces 21 and 23 of block 12 are slightly compressible, at least at the top lip 11 and the bottom lip 31. This allows block 12 to be easily squeezed between brackets 58 and 59 without breaking or tearing. Panel 10 is pressed into void space 51 until the brackets 58 and 59 of the door section 50 insert into and thereby engage grooves 15 and 18. Although lips 11 and 31 are compressible, grooves 15 and 18 are also sufficiently rigid so as to hold insulating panel 10 firmly engaged with door section 50.

In FIG. 2, insulating block 12 does not fill the void space to the point that it is in contact with outer wall 52. It is generally preferred for block 12 to occupy as much of void space 51 as practical. However, it is not necessary that it be attached to the inside of outer wall 52. This feature of the invention provides one of the advantages over the prior art. Many prior art insulating panels must be attached to the inside of a door section by means of tape or adhesive. This makes installment of the insulating panels difficult. The present invention does not require adhesion to the inside walls within the void space. The combined features of the invention provide an easy to install, removable, durable and aesthetically pleasing insulation panel installable by a process that does not require any tools or adhesives.

Void space 51 varies according to the style and model of sectional door. In some instances, void space 51 will be larger than insulating block 12. In addition, insulating block 12 does not substantially extend into the portion of the void space between the brackets and the outer wall. It may therefore be desirable to include inserts of insulating material in void space 51, such as upper insert 55 and lower insert 53. Such optional inserts provide additional insulation. Upper insert has a contact surface 67 that is flush with and engages top surface 21. Lower insert 53 has a contact surface 61 that abuts and engages bottom surface 23 of block 12. Bottom surface 23 includes a node 69 and a pocket 73 that engage complimentary node 77 and pocket 71 in contact surface 61 of insert 53. These complimentary nodes and pockets allow the insert 53 and the insulating panel 10 to hold one another firmly in place. The nodes and pockets shown in FIG. 2 are complimentarily concave and convex. However, engagement means of contact surface 61 and bottom surface 23 comprising nodes and pockets illustrate only one possible engagement means. Other geometries of engagement nodes and pockets are also suitable. Such engagement means are optional and may be included in one or both of top and bottom inserts. Alternatively, no engagement means may be used, as shown with top surface 21 and contact surface 67.

Figure 3:
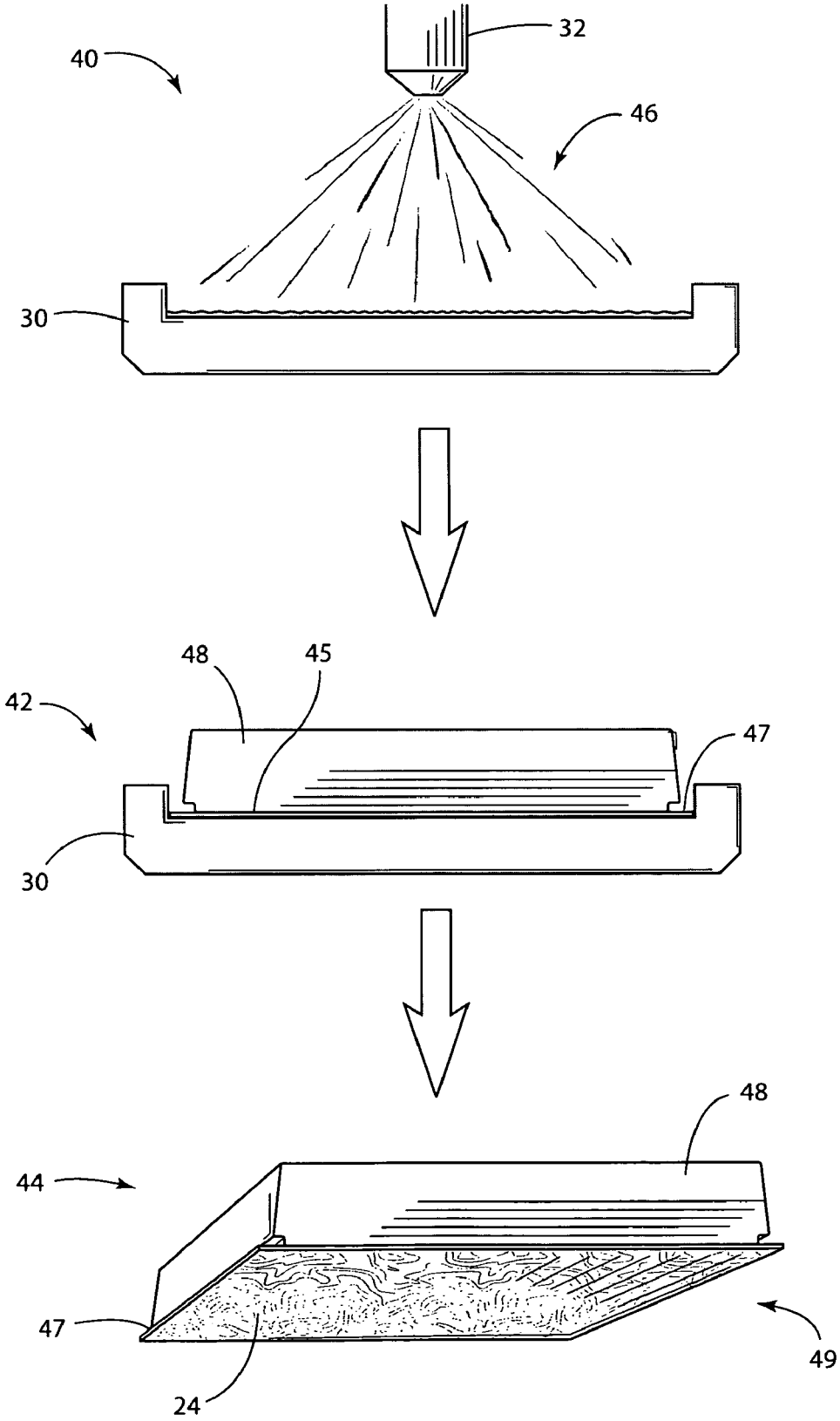
FIG. 3 is a stepwise diagram of a method of manufacturing an insulation panel of the invention.

FIG. 3 shows a process by which an insulating panel may be formed. In the first step 40, a prepolymer 46 is sprayed by one or more nozzles 32 into a bed 30. Sufficient prepolymer is added such that the sheet will form with the desired thickness. Bed 30 preferably has a textured design molded into it such that it may impart an aesthetically pleasing surface to the sheet once formed. As discussed above, polyurea polymers are well suited for the present invention. One of the reasons polyureas are preferred is their simple curing process which allows a protective sheet to be formed by simply spraying the prepolymers 46 into a molding bed 30.

In the second step 42, an insulating block 48 is placed in contact with prepolymers 46 as it cures. As prepolymers 46 polymerize, they interact with block 48 at interface 45. The polymerization reaction engages insulating block 48, and the block 48 becomes bonded to sheet 47 as the polymer cures. This step of the manufacturing process obviates the preference for a polymer having a mild curing process. Polyurea cures under ambient conditions that will not alter or modify EPS or other materials used to form the insulation block. Polyurea/polyurethane blends and other polymers suitable for the invention typically have mild curing conditions. Because the block 48 and sheet 47 become bonded during the curing process, there is no need for use of adhesives, other chemical bonding methods or mechanical bonding methods to hold the insulating panel together. However, accelerants, adhesives, curing agents and other compounds may be added to the interface 45.

Once the prepolymers have cured, complete insulating panel 49 is removed from bed 30 in the final step 44. The finished panel 49 has insulating block 48 firmly bonded to sheet 47 and is now ready to be used to insulate a sectional door. Sheet 47 has outer surface 24 that has a textured design molded into it by bed 30. This design on surface 24 serves to make the insulating block more aesthetically pleasing than other insulation methods known in the art. It may mimic wood grain, or have any design desired, including artistic representations, logos symbols or the like. Coloring chemicals may be added to prepolymers 46, or sheet 47 may be painted or otherwise treated to modify its color. When panel 49 is used to insulate a garage door, this aesthetically pleasing surface of sheet 47 gives the garage a look and feel of a real room as opposed to merely a storage area. Many people today use a garage for a variety of recreational activities, and such a design on surface 24 enhances this type of use of a garage space.

The process shown in FIG. 3 is one preferred method of manufacturing the invention. However, more common methods may be used. The insulating block and protective sheet may be formed independently and attached by means any means known in the art to fixedly attach the materials the two components are made of. The interface between the two components may be formed by any fixed attachment means such as but not limited to adhesive chemicals, bonding chemicals, mechanical attachment methods or other methods known in the art.

Preferably, panels 49 are formed in a variety of sizes and shapes to accommodate sectional doors of varying sizes. Panels having the same dimensions may be grouped together as kits for insulating garage and other sectional doors that are already installed and in use. Such kits are easily used by a door owner to retro-fit an existing door according to the installation method described above.

Figure 4:
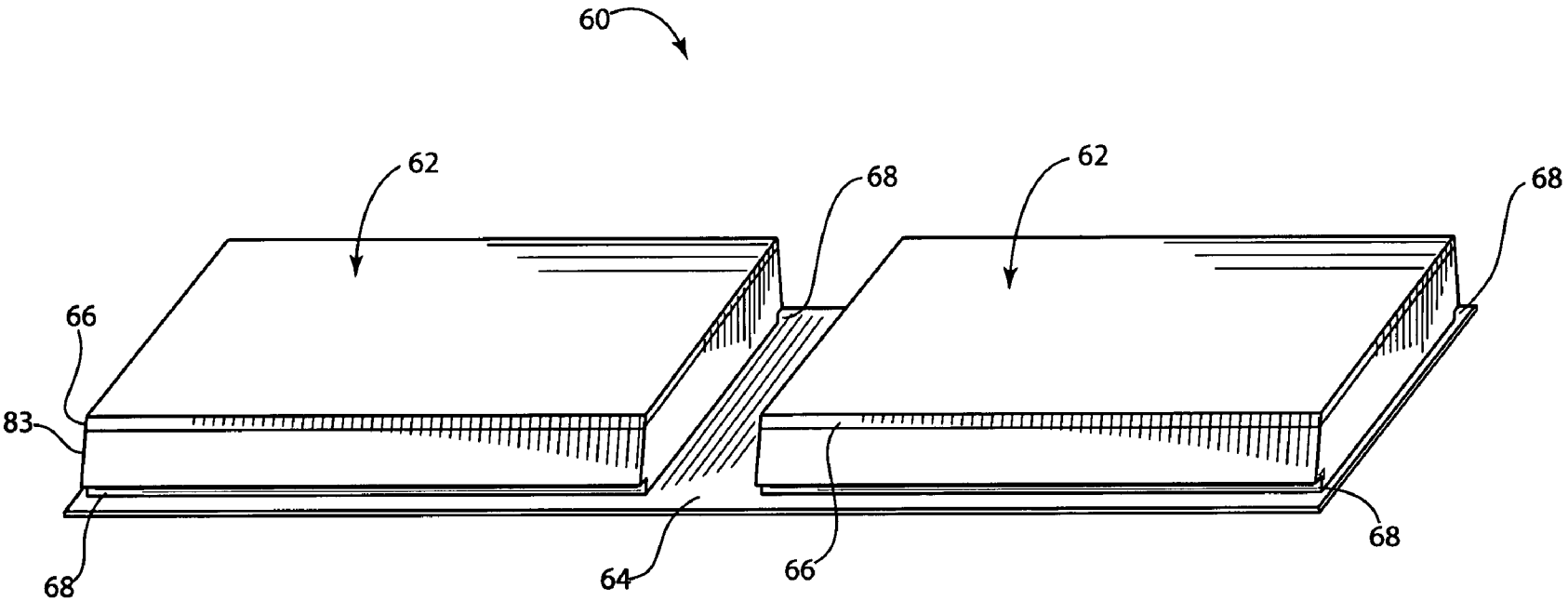
FIG. 4 is a perspective view of an alternative embodiment of the invention.

FIG. 4 shows an alternative embodiment of the invention. Insulation panel 60 has two insulating blocks 62 attached to a single protective sheet. This embodiment may be used on a door section that has a vertical stile for structural support. Panel 60 is designed to engage a sectional door such that a vertical stile is accommodated between the two blocks 62. Insulation panel 60 also includes barrier foils 66 on each block 62. Barrier foils 66 are optional and comprised of a second insulating material. In this embodiment, the layers are comprised of two aluminum sheets with a polyethylene reinforcing mesh between them. It is not practical to place barrier foils between the sheet 64 and blocks 62 as this would not allow the bonding between them during the polymer curing process as shown in FIG. 3. However, it may be desirable to apply one or more barrier foils to the insulating block as shown in FIG. 4.

Figure 5:
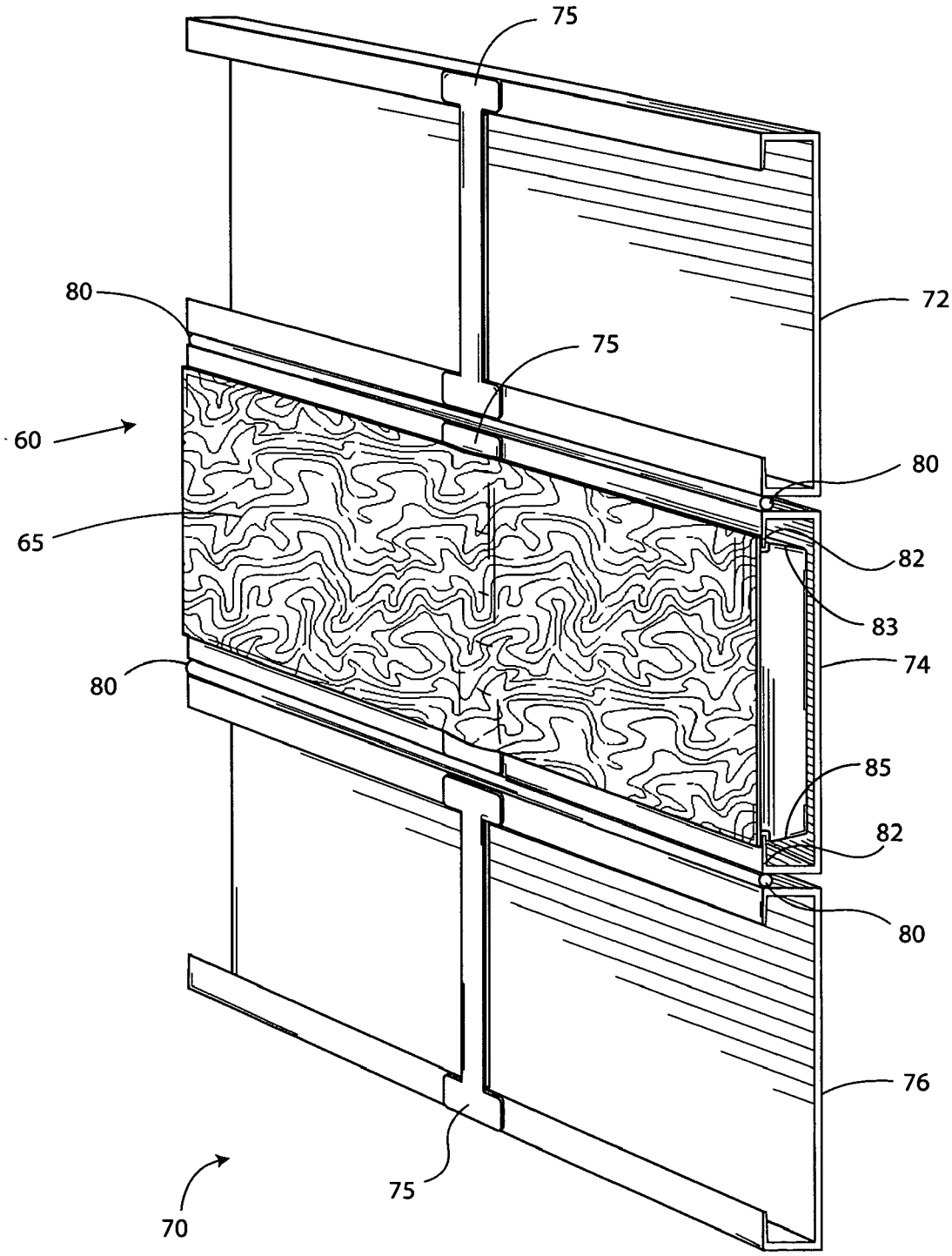
FIG. 5 is a perspective view of the embodiment of FIG. 4 engaged with a door section.

FIG. 5 shows panel 60 engaged with and secured to a garage door section 74. Garage door 70 has door sections 72, 74 and 76 that are attached to one another by hinges 80. Each section has a vertical stile 75 incorporated into it to provide support. Panel 60 is secured to section 74 by pressing insulating blocks 66 into the door section such that grooves 68 engage lips 82. Surface 65 of panel 60 has a textured surface. Sheet 64 extends the length of door section 74, covering and protecting insulating blocks 62 and stile 75 to provide a continuous panel. This gives the garage door a more uniform, attractive appearance. In this embodiment, two insulating blocks 62 are used to fit in a door section having one stile 75. Door sections may have no stiles and be more suited for the embodiment shown in FIG. 1. Other doors may have sections having one stile as shown in FIG. 5.

It is known to have garage and other sectioned doors with a plurality of vertical stiles to strengthen the sections. Alternative embodiments of the invention may be manufactured to accommodate such designs by forming a series of insulating blocks on a single protective sheet such that the insulating blocks are spaced by gaps, similar to the one shown in FIG. 5, to engage the void spaces between stiles while the protective sheet creates a continuous interior surface along the length of a door section. It may also be desirable to include vertical insulating inserts behind the stiles similar to the upper and lower inserts shown in FIG. 2.

A continuous protective sheet is beneficial for aesthetic reasons, but also for protective reasons. A continuous sheet covering the void space of a door section minimizes the amount of moisture, debris and other objects, including insects that may enter the void space. This provides for a safer and healthier environment in the space enclosed by the sectional door.

Figure 6:
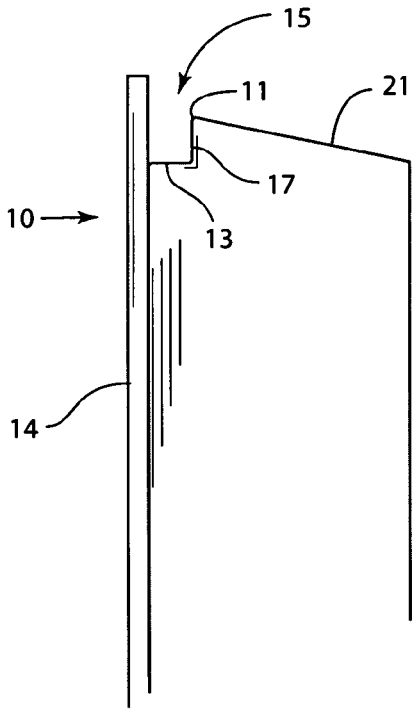
FIG. 6 is an enlarged side view of a groove of the invention.

FIGS. 6, 7, 8 and 9 show alternative embodiments of the groove of the invention. FIG. 6 shows an enlarged view of the groove 15 of insulating panel 10 shown in FIGS. 1 and 2. Groove 15 in block 12 has a rectangular cross section. Shelf 17 has an acute angle to top surface 21, and is substantially parallel to sheet 14 and substantially perpendicular to floor 13.

Figure 7:
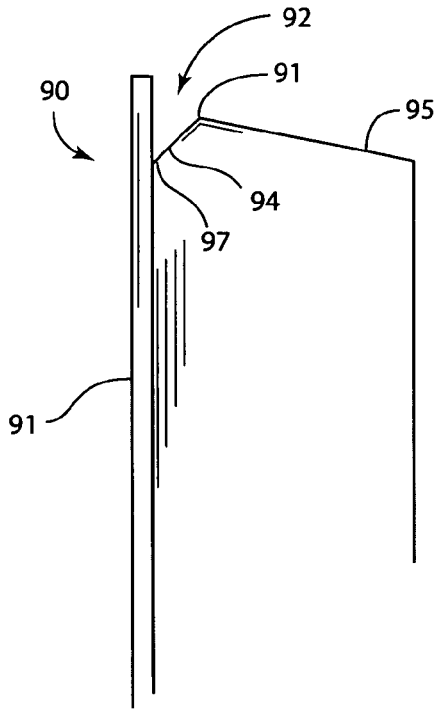
FIG. 7 is an enlarged side view of an alternative embodiment of a groove of the invention.

FIG. 7 shows an alternative insulating panel 90. In this embodiment, groove 92 in insulating block 95 has a triangular cross section shaped by angled shelf 94 with no groove floor and a deepest recess point 97 located where shelf 94 meets panel 91.

Figure 8:
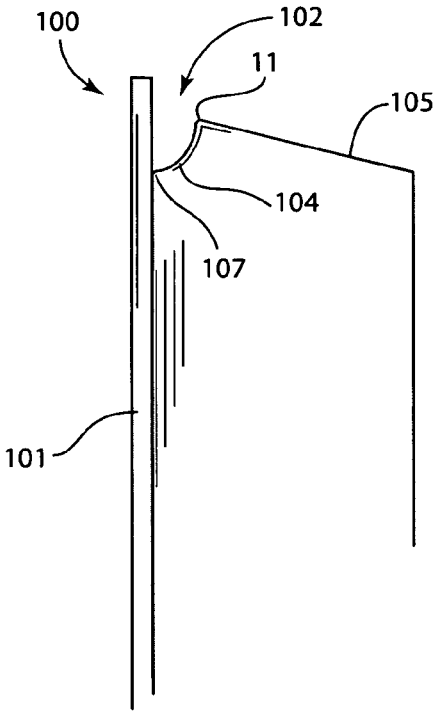
FIG. 8 is an enlarged side view of an alternative embodiment of a groove of the invention.

FIG. 8 shows another embodiment, that incorporates the floor and the shelf of the groove 102 into a single concave shelf 104 in insulating block 105. The deepest recess point 107 is located where surface 104 meets panel 101. This produces groove 102 having a curved cross section.

Figure 9:
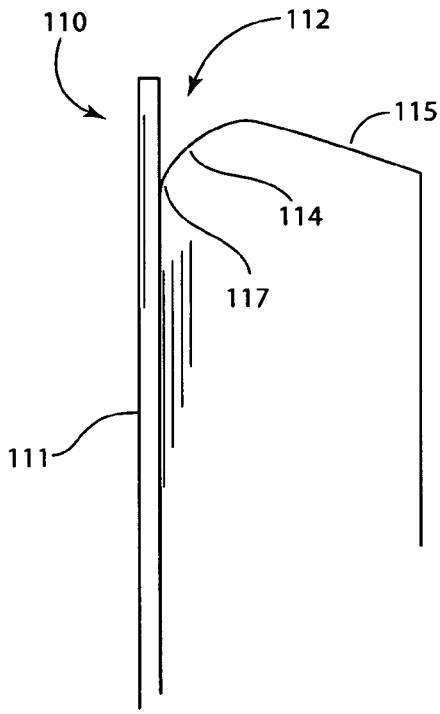
FIG. 9 is an enlarged side view of an alternative embodiment of a groove of the invention.

FIG. 9 shows another embodiment 110, in which groove 112 is formed by convex shelf 114 in block 116. Deepest recess point 117 is located where surface 114 meets panel 111.

In each of these embodiments, the groove is sized as explained in reference to FIG. 1. That is, a top groove and bottom groove are spaced such that they accommodate upper and lower brackets or other structures spaced apart a distance equal to or greater than the distance between the deepest recess points and less than the distance between the lips.

FIGS. 6-9 illustrate that there are many possible designs for the groove. So long as the groove engages the lips of a door section, the groove will be suitable for the invention. The dimensions of the insulation block, the protective sheet and the groove will vary depending on the dimensions of the door section it is to be fitted into.

FIG. 10 shows an alternative embodiment of the invention 150. Insulating panel 150 is comprised of a block 154 having an interface 152 with a sheet, not shown, that is inserted into door section 156. The block 154 of insulating panel 150 includes tabs 160 that partially cover lip 158 that form a groove adjacent the interface 152 as explained above. These tabs 160 are preferably formed from a plastic or other similarly substantially rigid material to provide strength to the engagement of the panel 150 to the door section 156. Those skilled in the art will appreciate that some insulating materials well suited for use with the insulating block 152, such as expanded polystyrene may be torn under stress or when rubbed against metal or other rigid materials. Tabs 160 provide strength to lips 158 to better secure attachment to a door section. FIG. 11 shows one of the tabs 160. Corner 162 is designed to sit flush against lip 158. Side 164 and end 166 conform to the shape of an insulating block to snugly fit against it. Such a tab 160 is preferably, but not necessarily, attached to the insulating block by an attachment means of an adhesive, a glue, an epoxy a resin or the like, or mechanical means such as a screw, a tack or the like. Tabs may also be formed by coating a material onto the block using methods such as spraying, brushing, dipping, chemical and/or catalyst coating methods or the like. FIG. 12 shows an alternative tab 172 covering the lip of insulating panel 170. Tab 172 runs along the entire length of the lip to provide rigidity to the engagement with the door section and to protect the lip from breaking or tearing. Tabs 160 and 172 illustrate that it may be desirable to provide extra strength, rigidity or protection to the lip of the insulating block. Such a tab may be a separate component and made of a material such as polymer, a metal or wood or any material that provides beneficial physical characteristics to the engagement of the insulating panel to the door section into which it fits. Alternatively, such a tab may be applied as a coating of a plastic hand/or elastomeric material. Descriptions of the embodiments shown in the drawings should not be construed as limiting or defining the ordinary and plain meanings of the terms of the claims unless such is explicitly indicated.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

I claim:

1. A sectional door insulation device comprising:

at least one insulating block having a downward sloped top surface, an upward sloped bottom surface, an outer surface and an interface surface;

a substantially planar protective sheet affixed to the interface surface, the protective sheet having a length greater than the insulating block, and the protective sheet extending beyond the top and bottom surfaces of the insulating block;

a top indentation on the top surface of the insulating block having a top lip and a top shelf;

a bottom indentation on the bottom surface of the insulating block having a bottom lip and a bottom shelf;

a top groove defined between the protective sheet and the top indentation of the insulating block; and a bottom groove defined between the protective sheet and the bottom indentation of the insulating block.

2. The sectional door insulation device of claim 1 wherein the protective sheet is composed of a polymer.

3. The sectional door insulation device of claim 2 wherein the polymer is a polyurea.

4. The sectional door insulation device of claim 1 further comprising an upper insert in contact with the downward sloped top surface of the insulating block.

5. The sectional door insulation device of claim 1 wherein the at least one insulating block is composed of a single material.

6. The sectional door insulation device of claim 5 wherein the single material is an expanded polymer.

7. The sectional door insulation device of claim 1 further comprising a barrier foil on the outer surface of the at least one insulating block.

8. The sectional door insulation device of claim 1 further comprising a lower insert having at least one engagement member, and the lower insert being engageable with the upward sloped bottom surface of the insulting block.

9. The sectional door insulation device of claim 1 further comprising a plurality of insulating blocks separated by one or more gaps.

10. The sectional door insulation device of claim 5 wherein the single material is a compressible material.

11. The sectional door insulation device of claim 1 further comprising a top groove floor between the top shelf and the protective sheet; and a bottom groove floor between the bottom shelf and the protective sheet.

12. A sectional door insulation system comprising:

a section of a sectional door having an upper bracket, a lower bracket, and an interior space defined between the upper bracket and the lower bracket;

at least one insulating block made of an expanded polymer and having a downward sloped top surface, an upward sloped bottom surface, an interface surface and an outer surface;

a polymer sheet coupled to the interface surface of the block;

a top indentation on the top surface of the insulating block having a top lip and a top shelf;

a bottom indentation on the bottom surface of the insulating block having a bottom lip and a bottom shelf;

a top groove formed between the sheet and the top indentation of the insulating block;

a bottom groove formed between the sheet and the bottom indentation of the insulating block;

the top lip and the bottom lip are sufficiently compressible to be snap fit between the upper bracket and the lower bracket, the upper bracket extending into the top groove and the lower bracket extending into the bottom groove.

13. The sectional door insulation system of claim 12 further comprising an upper insert at least partially enclosed by the upper bracket, and a lower insert at least partially enclosed by the lower bracket.

14. The sectional door insulation system of claim 12 further comprising a barrier foil on the outer surface of the at least one insulating block.

15. The sectional door insulation system of claim 13 further comprising the upper insert in contact with the downward sloped top surface of the insulating block and the lower insert in contact with the upward sloped bottom surface of the insulating block.

16. The sectional door insulation system of claim 12 further comprising a plurality of insulating blocks separated by at least one gap; and at least one vertical stile wherein the at least one vertical stile is accommodated by the at least one gap.

17. The sectional door insulation system of claim 13 further comprising the lower insert having at least one engagement member and being engageable with the upward sloped bottom surface of the insulating block.

* * * * *